US006807709B2

(12) United States Patent
Fernandez-Grandizo Martinez

(10) Patent No.: US 6,807,709 B2
(45) Date of Patent: Oct. 26, 2004

(54) VACUUM CLEANER COOLING SYSTEM

(75) Inventor: Jesus Fernandez-Grandizo Martinez, Mexico City (MX)

(73) Assignee: Koblenz Electrica, S.A. de C.V., Cauautitlan Izcalli (MX)

( * ) Notice: Subject to any disclaimer, the term of this patent is extended or adjusted under 35 U.S.C. 154(b) by 325 days.

(21) Appl. No.: 10/072,172

(22) Filed: Feb. 7, 2002

(65) Prior Publication Data

US 2003/0145426 A1 Aug. 7, 2003

(51) Int. Cl.[7] ..... A47L 9/00
(52) U.S. Cl. ..... 15/413; 15/327.2; 15/327.6
(58) Field of Search ..... 15/413, 422.2, 15/327.2, 327.6

(56) References Cited

U.S. PATENT DOCUMENTS

| | | | | |
|---|---|---|---|---|
| 2,884,185 | A | 4/1959 | Dolan | |
| 3,866,263 | A | 2/1975 | Crouser et al. | |
| 4,052,765 | A | 10/1977 | Guhne et al. | |
| 4,114,231 | A | 9/1978 | Nauta | |
| 4,213,224 | A | 7/1980 | Miller | |
| 4,547,206 | A | 10/1985 | Sovis et al. | |
| 4,665,581 | A | 5/1987 | Oberdorfer | |
| 5,974,623 | A | 11/1999 | Cummins et al. | |
| 6,003,200 | A | 12/1999 | Poots et al. | |
| 6,011,331 | A | 1/2000 | Gierer et al. | |
| 6,101,669 | A | 8/2000 | Martin et al. | |
| 6,175,988 | B1 * | 1/2001 | White et al. | 15/413 |
| 6,192,551 | B1 | 2/2001 | Roth | |
| 6,363,574 | B2 * | 4/2002 | Worden et al. | 15/413 |

* cited by examiner

*Primary Examiner*—Theresa T. Snider
(74) *Attorney, Agent, or Firm*—Widman, Harrold, Allen and Dixon LLP; Thomas J. Ring

(57) ABSTRACT

A cooling system for providing cooling air for a motor having a shaft extending through an opening within the motor, the motor being contained within a vacuum cleaner housing having a top and a bottom, the cooling system including a cooling-air inlet located in a side of the vacuum cleaner housing, a motor housing integral with the vacuum cleaner housing, the motor housing having a top portion defining a hole passing therethrough, the hole having a first dimension and being in flow communication with the cooling-air inlet, a side wall surrounding the hole and extending from the top portion of the motor housing, thereby enabling the cooling air to flow from the motor housing through an interior of the side wall, a baffle circumscribing the motor, the baffle having a second dimension that is greater than the first dimension enabling cooling air to pass through the opening in the motor adjacent the shaft with at least a portion of the motor positioned within the side wall and a cooling-air exhaust outlet located in the side of the vacuum cleaner housing in flow communication with the motor housing and spaced apart from and in flow communication with the cooling-air inlet.

25 Claims, 2 Drawing Sheets

VACUUM CLEANER COOLING SYSTEM

FIELD OF THE INVENTION

The invention involves a motor cooling system in general, and in particular, a cooling system for a small appliance motor such as is used in a vacuum cleaner.

BACKGROUND OF THE INVENTION

When in operation motors generate heat that must be dissipated in order to prevent the motor from overheating. This is particularly true when smaller motors are used to generate large amounts of power because as the more power that is generated, the hotter the motor becomes.

Various ways of cooling an operating motor are known in the art. These include the use of a fan, a heat exchanger, a cooling fluid and the passing of cooler air through the motor compartment.

Motors used in the operation of small appliances have, for the most part, been cooled by drawing ambient air from outside of the appliance, through the appliance housing and around the motor. This cooler ambient air acts as a heat exchanger as it mixes with the hot air generated by the motor thereby cooling the air immediately around the motor while exhausting the warmer air out of the housing.

Although somewhat effective, such a cooling process has a major drawback in that the cooling air is directed around the outside of the motor as opposed to passing directly through the inside of the motor where the heat is the greatest. Furthermore, in the design of most conventional appliances, warm air is exhausted out through the top of the appliance or motor housing.

By directing the flow of cooling air around the motor as opposed to directly through its interior, inefficient cooling results as the warmest part of the motor fails to contact the cooling air. This results in the motor operating at a warmer temperature. Because of this inefficiency, a cooling system that directed cooling air directly into the center of the motor would be an important improvement in the art.

Additionally, the exhausting of cooling air through the top of the appliance housing creates the possibility that water or some other type of liquid that is splashed or spilled on the housing could enter the housing thus resulting in the motor experiencing a short or being damaged in some other manner.

Because the injection of water or some other impurity into the motor housing of an appliance such as a vacuum cleaner could result in costly repairs or even the scraping of the appliance altogether, a cooling system having a cooling-air intake and cooling-air exhaust that would prevent liquids or other impurities from entering the motor compartment would be an important improvement in the art.

SUMMARY OF THE INVENTION

The invention involves a cooling system for providing cooling air for a motor having a shaft extending through an opening within the motor, the motor being contained within a vacuum cleaner housing having a top and a bottom. The inventive cooling system is comprised of a cooling-air inlet located in a side of a vacuum cleaner housing, a motor housing integral with the vacuum cleaner housing, the motor housing having a top portion defining a hole passing therethrough, with the hole having a first dimension and being in flow communication with the cooling-air inlet, a side wall surrounding the hole and extending from the top portion of the motor housing, thereby enabling the cooling air to flow from the motor housing through an interior of the side wall, a baffle circumscribing the motor, the baffle having a second dimension that is greater than the first dimension enabling the cooling air to pass through the opening in the motor along a length of the motor adjacent the shaft with at least a part of the motor positioned within the side wall, and a cooling-air exhaust outlet also located in the side of the vacuum cleaner housing in flow communication with the motor housing and spaced apart from and in flow communication with the cooling-air inlet.

BRIEF DESCRIPTIONS OF THE DRAWINGS

DETAILED DESCRIPTION OF THE INVENTION

Figure 1:
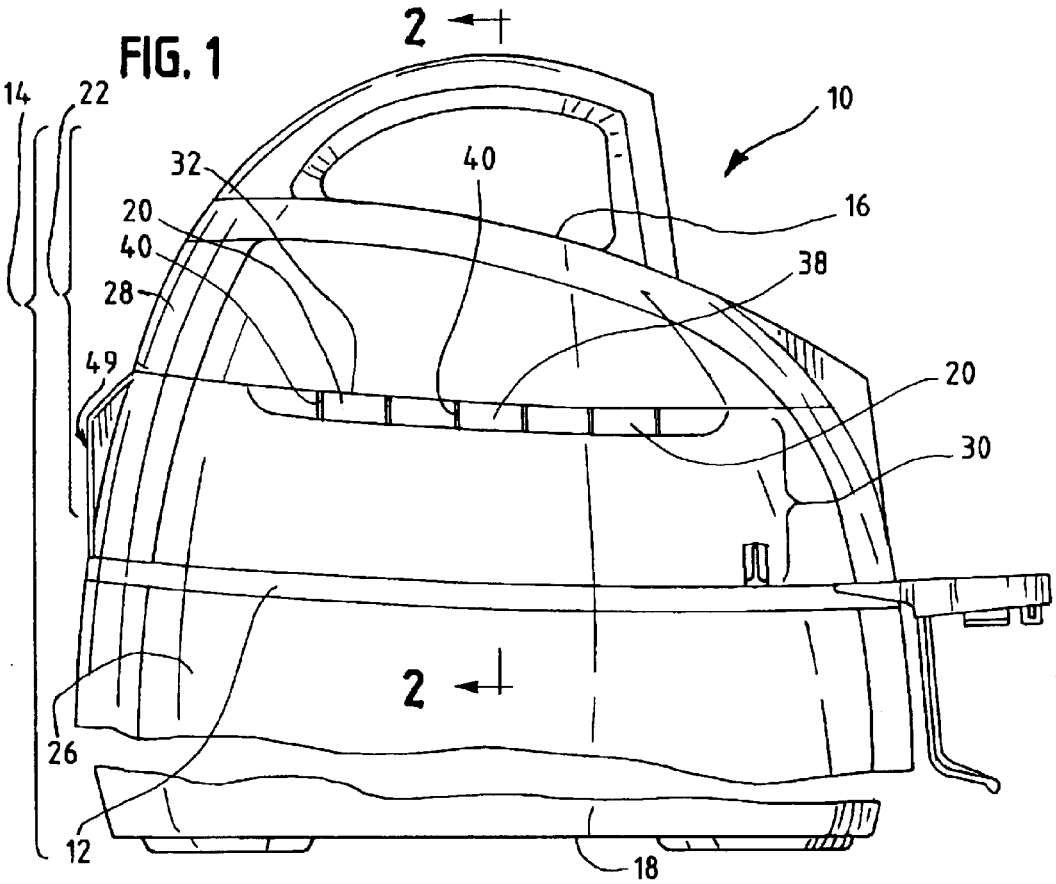
FIG. 1 is a side view of a portion of the vacuum cleaner housing showing the upper and lower portions of the housing.
Figure 2:
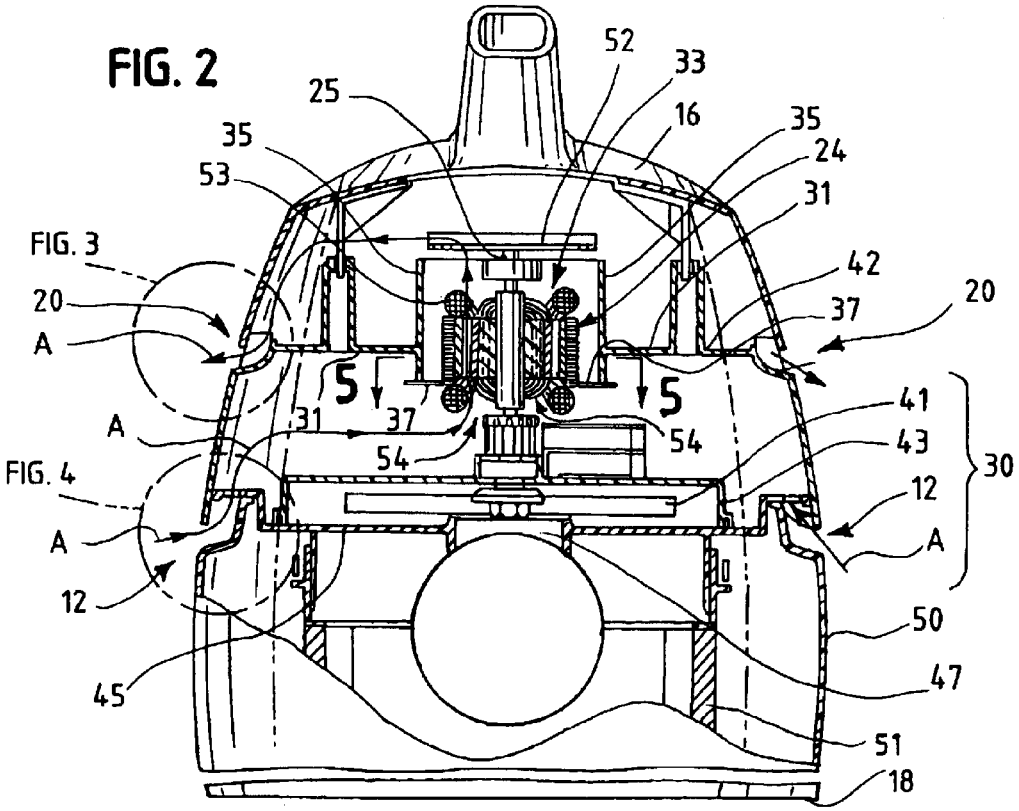
FIG. 2 is a cross-sectional view taken along line 2—2 of FIG. 1.

As shown in FIGS. 1 and 2, the invention involves a cooling system for providing cooling air (as indicated by arrow A) for a motor 24 having a shaft 25 extending through an opening 54 within the motor 24, the motor 24 is contained within a vacuum cleaner housing 14 having a top 16 and a bottom 18 and the cooling system is comprised of a cooling-air inlet 12 located in a side of the vacuum cleaner housing 14, a motor housing 30 integral with the vacuum cleaner housing 14, the motor housing 30 having a top portion 31 defining a hole 33 passing therethrough, the hole 33 being in flow communication with the cooling-air inlet 12 and having a first dimension, a side wall 35 surrounding the hole 33 and extending from the top portion 31 of the motor housing Cooling air A flows from cooling-air inlet 12 through interior of side wail 35. Baffle 37 which circumscribes motor 24 has a second dimension that is greater than the first dimension of hole 33 which enables the directing of cooling air A to pass through the opening 54 in the motor 24 adjacent the shaft 25 with at least a portion of the motor 24 positioned within the side wall 35. Cooling-air exhaust outlet 20 located in the side of the vacuum cleaner housing 14 is in flow communication with the motor housing and spaced apart from and in flow communication with the cooling-air inlet 12.

In particular, the invention involves a vacuum cleaner cooling system wherein the cooling-air inlet 12 extends generally parallel to the bottom 18 along at least a partial length of the side of the housing 14. Cooling-air exhaust outlet 20 extends generally parallel to the bottom 18 along at least a partial length of the side of the housing 14.

Figure 5:
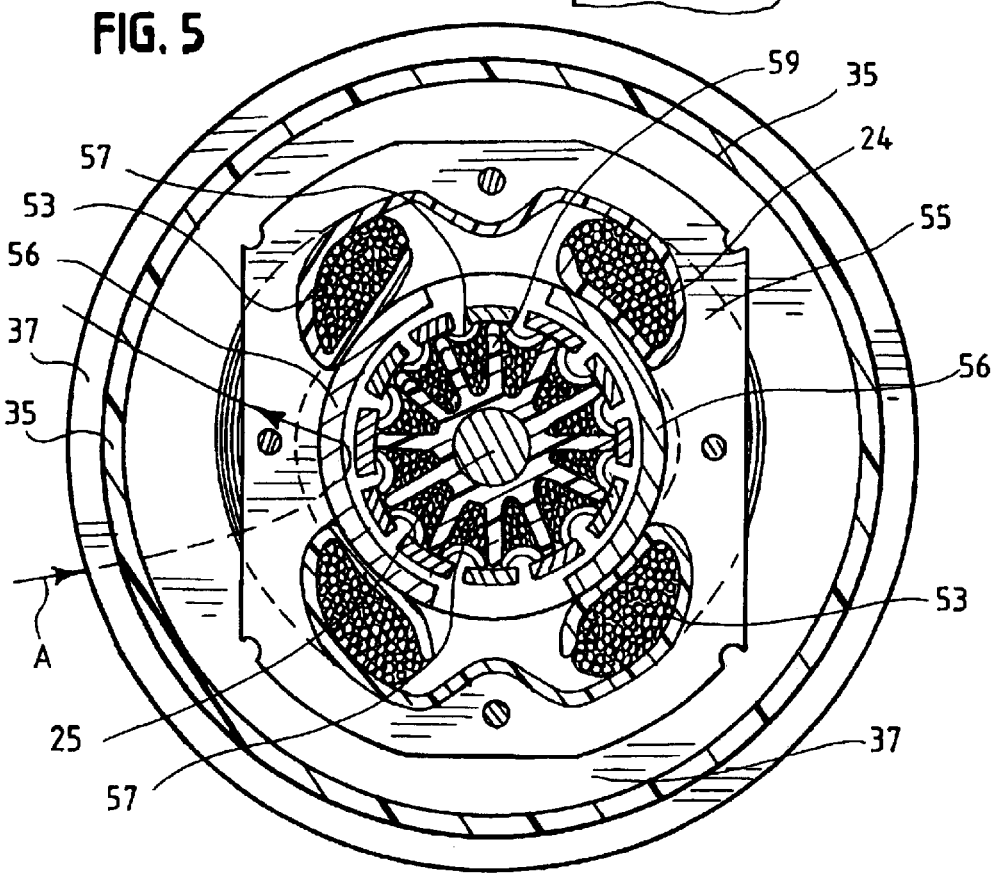
FIG. 5 is a cross-sectional view taken along line 5—5 in FIG. 2.

As shown in FIG. 5, the motor 24 used in conjunction with the inventive cooling system is, for example, an AC motor comprised of a field 55 surrounding a stator 56 that includes a set of windings 53 and a rotor 59 that includes a shaft 25 on which a second set of windings 57 are connected.

In one embodiment of the invention, the dimension of the hole 33 and baffle 37 are diameters. In another embodiment, as shown in FIGS. 1 and 2, the motor shaft 25 has a first end attached to a cooling fan 52 and a second end attached to an impeller 41. A motor mounting platform 43 is secured to the bottom 45 and, when the motor 24 is attached to the platform 43, the motor 24 is spaced apart from the mounting platform 43, as shown in FIG. 2.

Figure 3:
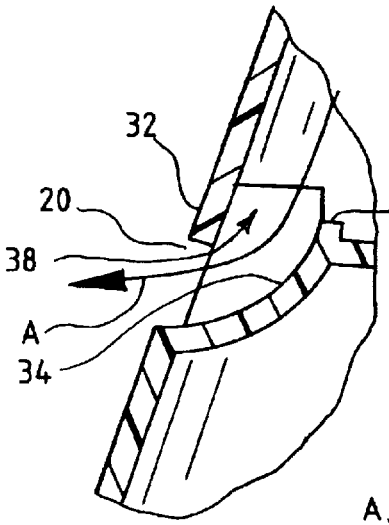
FIG. 3 is an enlarged view of the cooling air exhaust outlet as seen in FIG. 2.
Figure 4:
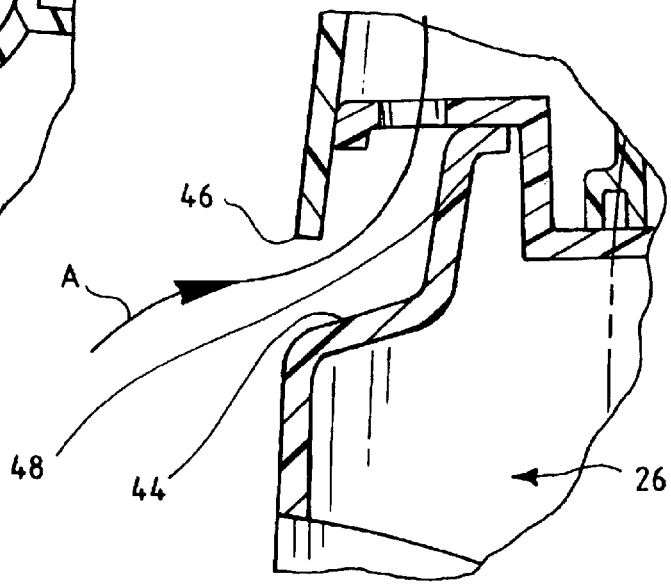
FIG. 4 is an enlarged view of the cooling air in let, as seen in FIG. 2.

In still another embodiment of the invention, the a housing 14 includes an upper portion 22 that contains a motor or power unit 24 and a lower portion 26 that may, for example, serve as a collection canister. The upper portion 22 is divided into a top and a bottom part 28, 30 and the cooling-air inlet 12 is formed in between the lower portion 26 and the bottom part 30 of the upper portion 22 while a cooling-air exhaust outlet 20 is located in the upper portion 22, in particular, between the top 28 and bottom 30 parts of the upper portion 22. In a more specific version of this embodiment, the bottom part 30 of the upper portion 22 is the motor housing. As shown in FIGS. 3 and 4, edge 32 and 46 may overhang a portion of both the cooling-air exhaust 20 and the cooling-air inlet 12, respectively.

In one embodiment of the invention, the bottom 45 of the motor housing 30 serves as a divider between the upper and lower portions 22, 26 of the vacuum cleaner housing 14. This bottom 45 includes a working-air intake (not shown) that extends from an opening 49 in the sidewall of the vacuum cleaner housing 14. When in operation, a hose or attachment is connected to the vacuum cleaner 10 via the opening 49 of the working-air intake.

The working-air intake is in flow communication with the lower portion 26 of the vacuum cleaner housing 14 such that working air drawn into the working-air intake passes directly into, for example, the collection canister. Once in the collection canister, the working air passes through the filter 51 where dust and debris are filtered out. Clean working air within the filter 51 is then pulled through the impeller 41 and discharged through a working-air exhaust (not shown) formed in conjunction with the motor mounting platform 43. Such an arrangement ensures that no working air mixes with any cooling air.

In yet another embodiment, the cooling-air exhaust outlet 20 may be formed by securing the top part 28 of the upper portion 22 to the bottom part 30. In such an embodiment, the top part 28 of the upper portion 22 of the vacuum cleaner housing 14 is circumscribed by a bottom edge 32, and when the top part 28 and the bottom part 30 of the upper portion 22 are joined together, the bottom edge 32 of the top part 28 extends beyond a top edge 60 of the bottom part 30, as shown in FIG. 3, thereby forming the cooling-air exhaust outlet 20. In a specific version of this embodiment, the bottom edge 32 of the top part 28 overhangs the top edge 60 of the bottom part 30.

As shown in FIGS. 2 and 3, the cooling-air exhaust outlet 20 may also include a bottom portion 34 that is angled inwardly and in a direction toward the top 16 of the vacuum cleaner housing 14. In an embodiment where the cooling-air exhaust outlet 20 does not extend along the entire length of the housing 14, the angling of the bottom portion 34 forms a channel 38 along the cooling-air exhaust outlet 20. A plurality of ribs 40, as shown in FIG. 1, may be positioned in channel 38 and be spaced apart along the length of the channel 38 to aid in the distribution of airflow. The angling of the bottom portion 34 of the cooling-air air exhaust outlet 20 inwardly and in a direction toward the top 16 of housing 14 allows the exhaust air to be directed downward and away from the vacuum cleaner housing 14.

The bottom portion 34 of the cooling-air exhaust outlet 20 may be connected to a platform 42 in the upper portion 22 of the vacuum cleaner housing 14. In a more specific version of this embodiment, the platform 42 is the top portion 31 of the motor housing and the bottom portion 34 of the air exhaust outlet 20 is integral with the platform 42 in the upper portion 22 of the vacuum cleaner housing 14. Such a platform 42 may separate the top and bottom parts 28, 30 of the upper portion 22 of the vacuum cleaner housing 14.

FIGS. 2 and 4 show a particular embodiment of the invention wherein the cooling-air inlet 12 includes a bottom surface 44 that is angled inwardly and in a direction toward the top 16 of the housing 14. This arrangement ensures that cooling air A drawn into the vacuum cleaner housing 14 is directed upward toward the top of the motor 24. Air inlet 12 may also be formed by the mating of the upper portion 22 of the vacuum cleaner housing 14 with the lower portion 26. In such an embodiment, the bottom part 30 of the upper portion 22 is circumscribed by a bottom edge 46, the lower portion 26 of the vacuum cleaner 10 is circumscribed by a top edge 48 and the bottom edge 46 extends outwardly beyond the top edge 48 thereby forming the air inlet 12, as shown in FIG. 4. In a more specific version of this embodiment, the bottom edge 46 overhangs the top edge 48.

In yet another embodiment of the invention as shown in FIG. 4, the lower portion 26 of the vacuum cleaner housing 14 has a sidewall 50 and the top edge 48 of the lower portion 26 is displaced inwardly of the sidewall 50. In such an embodiment, the sidewall 50 tapers inwardly toward the top edge 48, thereby forming the bottom surface 44 of the air inlet 12. In a more specific version of such embodiment, only a portion of the sidewall 50 tapers inwardly toward the top edge 48, thereby forming a channel (not shown) along the air inlet 12.

As shown in FIG. 2, when in operation, a fan 52 attached to the power unit or motor 24 draws cooling air A into the vacuum cleaner 10 through the cooling-air inlet 12 that is formed in the side of the housing 14. The angled bottom surface 44, as seen in FIG. 4, of the air inlet 12 causes the air A to be directed upward toward the top portion of the bottom part 30. Because, the baffle 37 circumscribing the motor 24 prevents any cooling air A from escaping the bottom part 30 around the outside of the motor 24, all of the cooling air A is channeled up and inside the armature through the opening 54 in the motor 24. This flow pattern causes the cooling air A to come in direct contact with the windings 53, 57 and the armature located inside the motor 24, as seen in FIG. 5.

By passing in contact with these components, the cooling air A draws heat off the motor 24. After passing through the motor 24, the air A is drawn through the top portion 31 of the motor housing into the top part 28 of the upper portion 22 of the vacuum cleaner housing 14 where it is exhausted downward through the cooling-air exhaust outlet 20 and away from the vacuum cleaner 10. Because both the cooling-air inlet 12 and cooling-air exhaust outlet 20 are located along the side of the vacuum cleaner housing 14, the inner workings of the vacuum cleaner 10 are protected in that no foreign substance (i.e., water or other impurities) can enter the inside of the housing 14 while the vacuum cleaner 10 is in operation.

The inventive cooling system allows air to be drawn into the vacuum cleaner housing 14 while preventing water or any other liquid from entering the housing 14. This keeps impurities and other foreign objects from being drawn into the power unit 24.

Conventional vacuum cleaners have included air exhaust outlets located in the top of the housing. Although this arrangement does work, it presents drawbacks in that water or other foreign particles can easily enter the vacuum cleaner through the exhaust outlet in the top of the housing. By locating both the cooling-air inlet 12 and cooling-air exhaust outlet 20 on the side of the vacuum cleaner housing 14 and, in particular, having a portion of the housing 14 overhang the inlet 12 and outlet 20, foreign material is prevented form entering the vacuum cleaner 10 thereby resulting in a safer operation.

While the principles of the invention have been shown and described in connection with but a few embodiments, it is understood clearly that such embodiments are by way of example and are not limiting.

What is claimed is:

1. A cooling system for providing cooling air for a motor having a shaft extending through an opening within the motor, the motor being contained within a vacuum cleaner housing having a top and a bottom, the cooling system comprised of:

a cooling-air inlet located in a side of the vacuum cleaner housing;

a motor housing integral with the vacuum cleaner housing, the motor housing having a top portion defining a hole passing therethrough, the hole having a first dimension and being in flow communication with the cooling-air inlet;

a side wall surrounding the hole and extending from the top portion of the motor housing, thereby enabling the cooling air to flow from the motor housing through an interior of the side wall;

a baffle circumscribing the motor, the baffle having a second dimension that is greater than the first dimension enabling cooling air to pass through the opening in the motor along a length of the motor aligned with the shaft of the motor with at least a portion of the motor positioned within the side wall; and a cooling-air exhaust outlet located in the side of the vacuum cleaner housing in flow communication with the motor housing and spaced apart from and in flow communication with the cooling-air inlet.

2. The cooling system of claim 1 wherein the cooling-air inlet extends generally parallel to the bottom along at least a partial length of the side of the vacuum cleaner housing.

3. The cooling system of claim 1 wherein the cooling-air exhaust outlet extends generally parallel to the bottom along at least a partial length of the side of the vacuum cleaner housing parallel to the cooling-air inlet.

4. The cooling system of claim 1 wherein the first and second dimensions are each a diameter.

5. The cooling system of claim 1 wherein:

the shaft has a first end and a second end;

a cooling fan is attached to the first end of the shaft; and an impeller is attached to the second end.

6. The cooling system of claim 1 wherein:

a motor mounting platform forms the bottom of the motor housing and the opening in the motor is positioned spaced apart from the mounting platform with the motor secured to the platform.

7. The cooling system of claim 1 wherein a portion of the vacuum cleaner housing overhangs the cooling-air inlet.

8. The cooling system of claim 1 wherein a portion of the vacuum cleaner housing overhangs the cooling-air exhaust outlet.

9. The cooling system of claim 1 wherein the vacuum cleaner housing is comprised of an upper portion and a lower portion.

10. The cooling system of claim 9 wherein:

the upper portion includes a top part and a bottom part; and the top part is circumscribed by a bottom edge in which the bottom edge extends beyond a top edge of the bottom part.

11. The cooling system of claim 10 wherein the bottom edge of the top part overhangs the top edge of the bottom part.

12. The cooling system of claim 10 wherein the bottom part of the upper portion is the motor housing.

13. The cooling system of claim 10 wherein the cooling-air exhaust outlet is formed by securing the top part of the upper portion to the bottom part of the upper portion.

14. The cooling system of claim 10 wherein the top portion of the motor housing separates the top part and the bottom part of the upper portion of the vacuum cleaner housing.

15. The cooling system of claim 10 wherein:

the bottom part of the upper portion is circumscribed by a bottom edge;

the lower portion of the vacuum cleaner housing is circumscribed by a top edge; and the bottom edge of the bottom part of the upper portion extends outwardly beyond the top edge.

16. The cooling system of claim 15 wherein the bottom edge of the bottom part of the upper portion overhangs the top edge.

17. The cooling system of claim 15 wherein:

the lower portion of the vacuum cleaner housing has a sidewall;

the top edge of the lower portion is displaced inwardly of the side wall; and the sidewall tapers inwardly toward the top edge, thereby forming a bottom surface of the cooling-air inlet.

18. The cooling system of claim 17 wherein a portion of the sidewall tapers inwardly toward the top edge forming a channel along the cooling-air inlet.

19. The cooling system of claim 9 wherein the lower portion is a collection canister.

20. The cooling system of claim 1 wherein the cooling-air exhaust outlet includes a bottom portion angled inwardly and in a direction toward the top of the vacuum cleaner housing.

21. The cooling system of claim 20 wherein the bottom portion forms a channel along the cooling-air exhaust outlet.

22. The cooling system of claim 20 wherein the bottom portion of the cooling-air exhaust outlet is connected to the top portion of the motor housing.

23. The cooling system of claim 22 wherein the bottom portion of the cooling-air exhaust outlet is integral with the top portion of the motor housing.

24. The cooling system of claim 21 wherein a plurality of spaced apart ribs are positioned along a length of the channel.

25. The cooling system of claim 1 wherein the cooling-air inlet includes a bottom surface angled inwardly and in a direction toward the top of the vacuum cleaner housing.

* * * * *

UNITED STATES PATENT AND TRADEMARK OFFICE

CERTIFICATE OF CORRECTION

PATENT NO. : 6,807,709 B2
DATED : October 26, 2004
INVENTOR(S) : Jesus Fernandez-Grandizo Martinez It is certified that error appears in the above-identified patent and that said Letters Patent is hereby corrected as shown below:

Column 1,
Line 13, delete “as”.

Column 2,
Line 22, change “in let” to -- inlet --.
Line 37, delete “30”
Line 38, delete “30”.
Line 44, change “wail” to -- wall --.
Line 63, after “rotor 59 that includes” delete “a” (third occurrence).

Column 3,
Lines 20 and 21, delete “of the meter housing 30”.
Line 46, delete “60” and insert therefor -- 34 --.
Line 49, delete “32” and insert therefor -- 30 --.
Line 49, delete “60” and insert therefor -- 34 --.

Column 4,
Line 17, delete “a”.

Column 5,
Line 7, change “form” to -- from --.

Signed and Sealed this

Seventeenth Day of May, 2005

JON W. DUDAS
*Director of the United States Patent and Trademark Office*